United States Patent [19]

Errichiello

[11] 4,295,747

[45] Oct. 20, 1981

[54] INTEGRALLY MOLDED, LOOSELEAF BOOKS WITH RING-BINDER-MOUNTING POSTS MOLDED ON SPINE

[76] Inventor: Dominic R. Errichiello, 389 Meadowlark Rd., Bloomingdale, Ill. 60108

[21] Appl. No.: 63,864

[22] Filed: Aug. 6, 1979

[51] Int. Cl.[3] ..... B42F 13/12; B42D 3/00

[52] U.S. Cl. ..... 402/75; 402/80 P; 281/36

[58] Field of Search ..... 402/73, 74, 75, 76, 402/80 P; 281/36, 29; 24/41

[56] References Cited

U.S. PATENT DOCUMENTS

| | | | |
|---|---|---|---|
| 388,402 | 8/1888 | Dodge | 24/41 |
| 2,325,155 | 7/1943 | Wedge | 402/75 |
| 2,364,859 | 12/1944 | Lichtenstein | 402/75 |
| 2,512,415 | 6/1950 | Buenger | 402/75 |
| 2,772,427 | 12/1956 | Rankin | 402/75 |
| 3,083,714 | 4/1963 | Foster | 402/75 X |
| 3,087,498 | 4/1963 | Vogel | 402/80 P |
| 3,167,328 | 1/1965 | Dengle et al. | 281/29 |
| 3,175,847 | 3/1965 | McKowen | 281/36 |
| 3,201,145 | 8/1965 | Libby | 281/29 |
| 3,260,264 | 7/1966 | McKowen | 281/25 R X |
| 3,809,485 | 5/1974 | Beyer | 402/75 |

FOREIGN PATENT DOCUMENTS

| | | | |
|---|---|---|---|
| 2315397 | 1/1977 | France | 402/74 |

*Primary Examiner*—Paul A. Bell
*Assistant Examiner*—John S. Brown
*Attorney, Agent, or Firm*—Keil & Witherspoon

[57] ABSTRACT

One piece, molded, looseleaf books having a plastic spine and front and rear, plastic cover panels integrally molded with the spine and hingedly connected to the spine by living, plastic hinges, said spine having on its inner face a plurality of tubular posts on which a snap-ring binder is mounted and is secured thereon by drive or clinch rivets pressed into the tubular posts.

5 Claims, 5 Drawing Figures

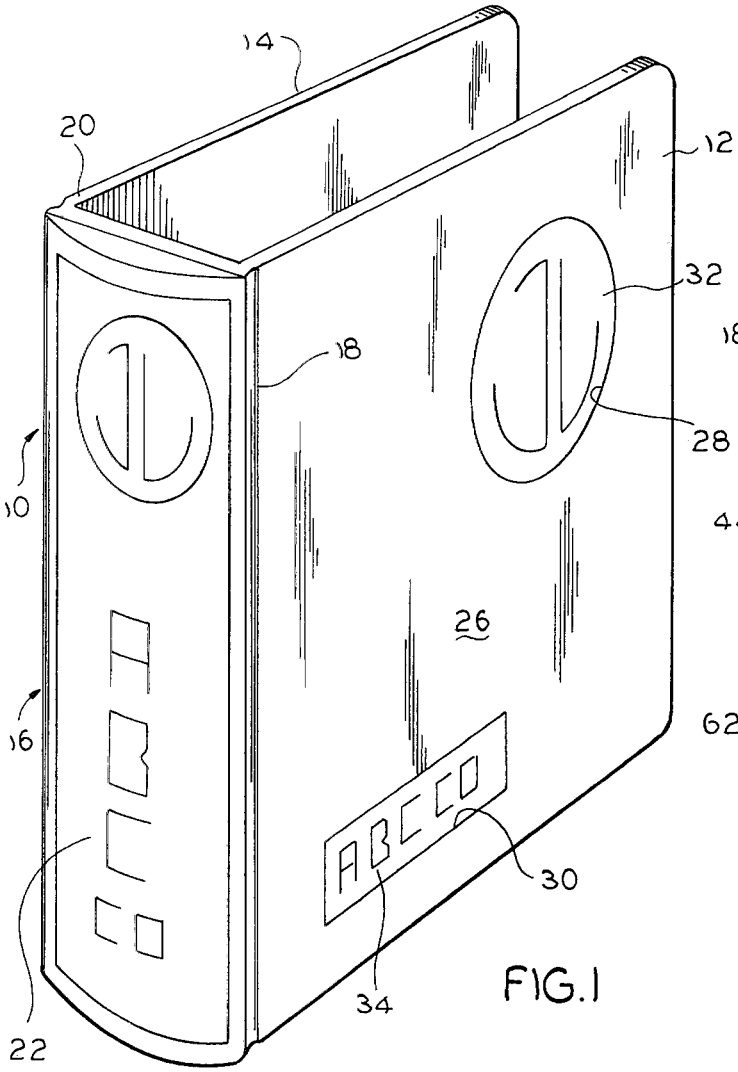
FIG.1
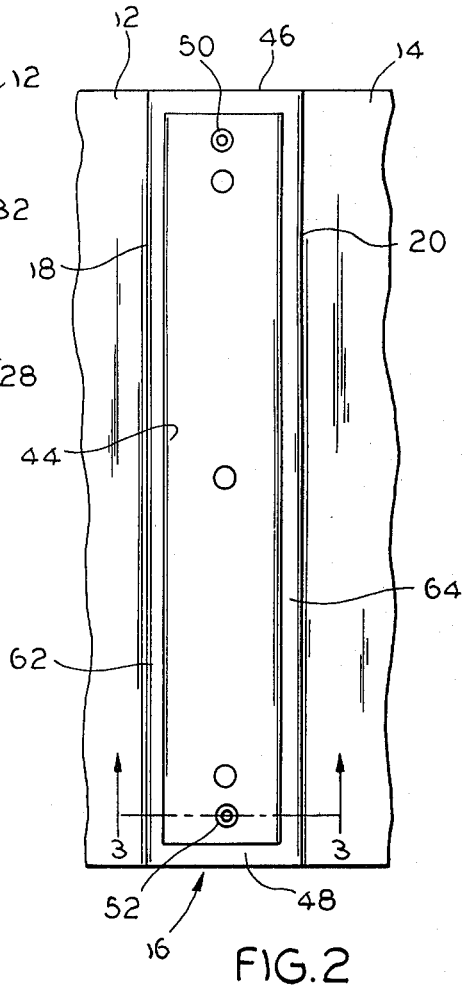
FIG.2
FIG.5
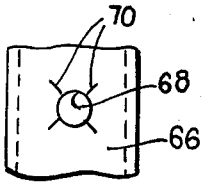
FIG.4
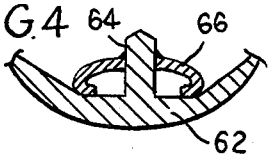
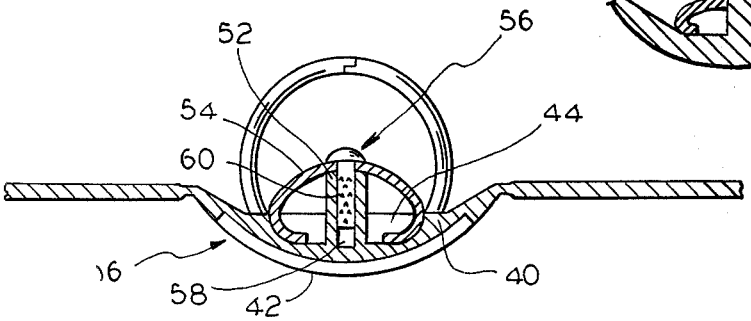
FIG.3

INTEGRALLY MOLDED, LOOSELEAF BOOKS WITH RING-BINDER-MOUNTING POSTS MOLDED ON SPINE

BACKGROUND AND BRIEF DESCRIPTION OF THE INVENTION

This invention pertains to new innovations in looseleaf books with snap ring assemblies for holding paper sheets with holes punched therein near an edge of the sheets. The invention provides one piece moldings of a spine with front and rear cover panels connected to opposite, longitudinal edges of the spine by integral, plastic, living hinges, and snap-ring assembly-mounting posts integrally molded on the inner face of the spine. The subject invention is closely related to the looseleaf books described and claimed in my copending U.S. application Ser. No. 63,863 filed Aug. 6, 1979. The disclosure of said copending application is incorporated herein by reference as if it had been set forth in its entirety.

The most common style of known, looseleaf books such as three-ring notebooks consist of rectangular paperboard or cardboard sheets forming the matrices for the front and rear cover panels and a rigid, often metal strip forming the matrix for the spine, to which the snap-ring assembly is riveted or pinned. The spine and two cover panels (one or both sides) are covered with a vinyl plastic sheet or other sheet material, the segment of the sheet at the junctures of the two longitudinal edges of the spine and the respective cover panels forming the hinges by which the cover panels are pivotally connected to the spine.

The snap ring assemblies for the known notebooks are usually fastened in the books by rivets extending through holes in the spine and aligned holes or tubular inserts in the metal strip matrix of the snap-ring assembly. The rivet heads are usually exposed on the outer, rear face of the spine.

This invention provides new combinations for mounting the snap-ring assemblies of looseleaf books on the spines thereof in a manner wherein the outer, rear face of the spine does not have exposed rivet heads thereon. The tubular post mounts for such assemblies enables an easier and simpler means for securing the assemblies on the spine.

PREFERRED EMBODIMENT

A preferred embodiment of the invention is illustrated in the drawings, wherein:

In the Drawings:

FIG. 1 is a rear perspective view of a looseleaf book of the invention;

FIG. 2 is a fragmentary, front elevation of the front, inner face of the spine of said book and fragments of the front and rear cover panels hingedly connected thereto;

FIG. 3 is a section view taken on section plane 3—3 of FIG. 2;

FIG. 4 is a fragmentary sectional view of another embodiment for mounting the snap ring assembly; and FIG. 5 is a fragmentary, top plan view thereof.

Referring to the drawings, the looseleaf book 10 comprises a front cover panel 12, a rear cover panel 14 and a spine 16 molded integrally from a thermoplastic polymer molding composition, preferably of a thermoplastic polymer which becomes molecularly oriented when the integrally formed hinges (weak zones) are flexed several times while the molding is still hot. Such polymers include polypropylene and polypropylene/polyethylene mixtures or copolymers. The hinge which results at the weakened zone is virtually free from cracking or tearing and is known in the art as a "living hinge."

Referring to FIG. 1, the living hinges 18 and 20 are formed at the junctures of the spine 16 and the front and rear cover panels 12 and 14 by the opposed V-notches which leave a narrow neck of thermoplastic material which is the weakened zone at which the aforesaid flexing occurs, thereby integrally hinging the two cover panels 12, 14 along the opposed longitudinal edges of the spine 16.

The front face 26 of the front panel 12 has a circular, shallow cavity 28 and a rectangular, shallow cavity 30 therein. These cavities respectively receive a separately molded thin disc insert 32 and a rectilinear, thin insert 34. Each insert bears printing, indicia, logoes, designs, symbols, etc. customized to suit the needs and desires of the ultimate customer-user or customer-retailer for the looseleaf books. Thus, the basic unit consisting of the spine and the two cover panels with or without inserts in the cavited front panel can be used as the basic components for customized notebooks of many divergent ultimate customers or users. Examples of the latter are manufacturers and/or distributors who use the looseleaf books as catalogs, manuals, promotions, sales aids, etc. for their goods. Similar uses by enterprises in the service fields include those insurance companies, utilities, household and office maintenance services, instruction services, such as cooking recipes, realtors, and a host of others. In every instance, a given sum of looseleaf books can be individually customized in a variety of color combinations and with particular, individualized, embossed, flat or raised lettering, designs, logoes, etc. for a particular customer or user by simply changing the mold for the insert. Similarly, snap-ring notebooks sold at stores servicing high school students, university or college students, trade school students and the like, can have inserts which reflect the name, mascot, seal, or other insignia for any given institution of learning. The most in special molding die costs chargeable to each customer for individualized books would be the die costs for the inserts and for the hereinafter described spine insert, if the latter is also customized.

The spine 16 comprises a longitudinal, transversely curved wall 40 (FIG. 3) having a longitudinal, shallow, transversely convex cavity 42 in its outer face. A mating, transversely curved, spine insert 22 is press-fitted or otherwise secured in the cavity.

The inner face of the spine 16 comprises a longitudinal cavity 44 extending between end walls 46, 48 at opposite ends of the cavity. The cavity has a bottom wall, two side walls and two diagonal walls extending between the bottom wall and a respective side wall.

Two tubular posts 50, 52 project outwardly from and at right angles to the bottom wall of the cavity 44 at opposite ends thereof. The matrix strip 54 of a snap-ring assembly has holes positioned to fit over the two posts 50, 52. The matrix is secured on the posts by drive or clinch rivets 56 whose shanks 60 are secured in the tubular passage 58 in the posts 50, 52 by barbs, shoulders, ribs or other known biting means on the shanks 60. Most of the matrix strip 54 is within the cavity 44. All sharp edges are encased in the cavity by the end walls 46, 48 and the side walls of the cavity.

If desired, the new, modified forms of snap-ring assemblies and their matrix strips, as disclosed in the aforesaid application, may be substituted for the snap-ring assembly 56 to provide matrix strips which are more flush with the end walls 46, 48 and edge walls 62, 64 of the inner face of the spine.

It will be appreciated from the foregoing that the invention herein can take many forms other than the preferred forms shown in the drawings and that the invention as herein claimed is not limited to the illustrated embodiments.

For example, the plastic or metal matrix strip 66 with its holes 68 may be mounted on a pair of (or three) plastic solid posts or tubes. They are molded integrally with the spine 62 of the looseleaf book such as is illustrated in FIGS. 1-3. There are three or four, equally spaced, radial slits 70 which provide three or four fingers about the hole 68. These fingers flex upwardly when the holes 68 are pressed over the posts or tubes 64 of slightly larger diameter than the holes 68. With metal fingers in a metal matrix strip 66, the fingers bite into the plastic tube or post 64 when the parts are assembled as in FIG. 4. With plastic fingers in a plastic matrix strip 66, a small ring or collar near the free end of the posts or tubes adds in keeping the fingers from slipping off the ends thereof.

I claim:

1. An integrally molded looseleaf book constructed of a thermoplastic polymer material having a snap-ring assembly mounted therein, said looseleaf book comprising:

a spine having front and rear cover panels hingedly mounted on respective opposite, longitudinal edges thereof by means of living hinges;

two or more posts formed in the inner front face of said spine;

means for mounting the matrix strip of said snap-ring on said posts; and a longitudinal cavity formed in the inner front face of said spine and extending substantially the full length of said spine, said posts being integrally molded in the bottom wall of said spine cavity, and said matrix strip being positioned longitudinally in said cavity.

2. The looseleaf book as claimed in claim 1, wherein said mounting means includes holes corresponding to said posts formed in said snap-ring assembly matrix strip, said holes having fingers formed about their periphery which are adapted to grip said posts for holding said snap-ring assembly on said spine.

3. An integrally molded looseleaf book constructed of a thermoplastic polymer material having a snap-ring assembly mounted therein, said looseleaf book comprising:

a spine having front and rear cover panels hingedly mounted on respective opposite, longitudinal edges thereof by means of living hinges;

two or more posts formed in the inner front face of said spine;

means for mounting the matrix strip of said snap-ring on said posts; and said means for mounting said matrix strip includes a tubular passage formed in each post, holes corresponding to said posts formed in said snap-ring assembly matrix strip, and fasteners having a shank member which extends through said matrix strip holes and is tightly fitted within said post tubular passages for holding said snap-ring assembly on said spine.

4. The looseleaf book as claimed in claim 3, wherein said fasteners are rivets having means for gripping the inner walls of said post tubular passages formed on their shanks.

5. The looseleaf notebook as claimed in claim 3 further comprising a longitudinal cavity formed in the inner front face of said spine, said posts being integrally molded in the bottom wall of said spine cavity, and said matrix strip being positioned longitudinally in said cavity.

* * * * *